United States Patent [19]

Kaufmann

[11] 4,314,753

[45] Feb. 9, 1982

[54] AUTOMATIC INVERSE FIX REPLENISHER CONTROL

[75] Inventor: Kenneth M. Kaufmann, Minneapolis, Minn.

[73] Assignee: Pako Corporation, Minneapolis, Minn.

[21] Appl. No.: 168,025

[22] Filed: Jul. 14, 1980

[51] Int. Cl.[3] ..... G03D 3/06

[52] U.S. Cl. ..... 354/321; 354/298; 137/624.15; 222/76

[58] Field of Search ..... 354/321, 322, 323, 324, 354/298; 134/94; 250/578, 559; 137/93, 624.15; 355/10, 27; 356/443, 444; 222/70, 76

[56] References Cited

U.S. PATENT DOCUMENTS

| | | | |
|---|---|---|---|
| 3,472,143 | 10/1969 | Hixon et al. . | |
| 3,529,529 | 9/1970 | Schumacher . | |
| 3,554,109 | 1/1971 | Street et al. . | |
| 3,559,555 | 2/1971 | Street . | |
| 3,559,555 | 2/1971 | Street | 354/298 |
| 3,561,344 | 2/1971 | Frutiger et al. . | |
| 3,696,728 | 10/1972 | Hope . | |
| 3,752,052 | 8/1973 | Hope et al. . | |
| 3,787,689 | 1/1974 | Fidelman . | |
| 3,822,723 | 7/1974 | Crowell et al. . | |
| 3,822,723 | 7/1974 | Crowell | 222/70 |
| 3,927,417 | 12/1975 | Kinoshita et al. . | |
| 3,990,088 | 11/1976 | Takita . | |
| 4,057,818 | 11/1977 | Gaskell et al. . | |
| 4,104,670 | 8/1978 | Charnley et al. . | |
| 4,119,952 | 10/1978 | Takahashi et al. . | |
| 4,128,325 | 12/1978 | Melander et al. . | |
| 4,134,663 | 1/1979 | Laar et al. . | |
| 4,174,169 | 11/1979 | Melander et al. . | |

*Primary Examiner*—L. T. Hix
*Assistant Examiner*—Stafford D. Schreyer
*Attorney, Agent, or Firm*—Kinney, Lange, Braddock, Westman and Fairbairn

[57] ABSTRACT

A processor of photosensitive material includes an automatic control system for providing both developer and fix exhaustion replenishment. As each strip of photosensitive material enters the processor, the width and length of the strip is sensed. Based upon the width and length, a determination of the area of each strip is made. The density of each strip is sensed after processing. Developer exhaustion replenishment and fix exhaustion replenishment are separately controlled. The developer exhaustion replenishment is provided as a function of a product of the area of the strip, the density of the strip, and a stored developer exhaustion rate. Fix exhaustion replenishment is provided as a function of a product of the area of the strip, an inverse of the density of the strip, and a stored fix exhaustion rate. A carryover rate is also stored which is indicative of carryover of developer fluid from the developer tank into the fix tank of the processor. A minimum fix replenishment is determined as a function of a product of the carryover rate and the area of the strip. If the minimum fix replenishment exceeds the fix exhaustion replenishment, the minimum fix replenishment is provided to the fix tank.

4 Claims, 1 Drawing Figure

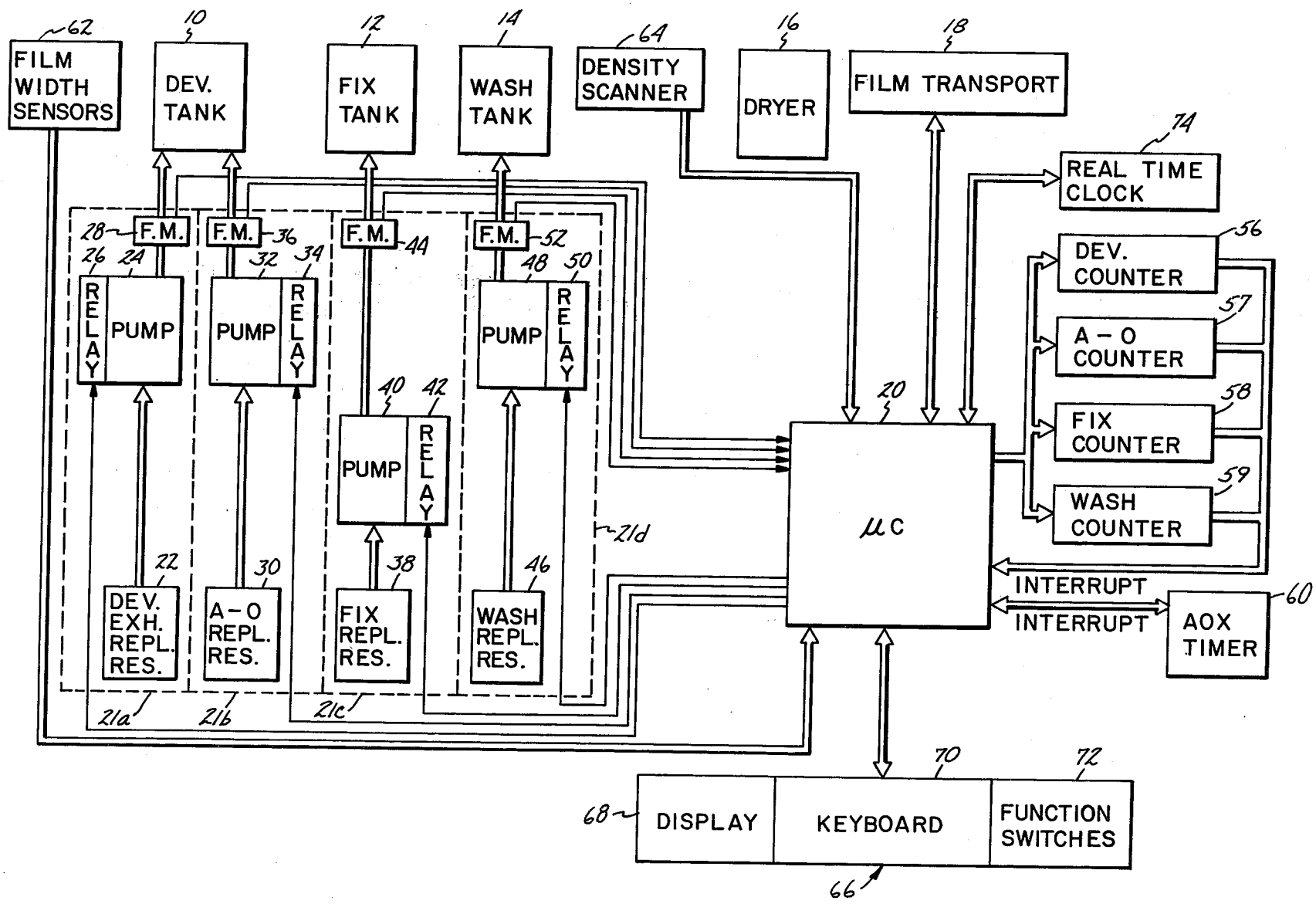
FILM WIDTH SENSORS
62
DEV. TANK
10
FIX TANK
12
WASH TANK
14
DENSITY SCANNER
64
DRYER
16
FILM TRANSPORT
18
REAL TIME CLOCK
74
DEV. COUNTER
56
A-O COUNTER
57
FIX COUNTER
58
WASH COUNTER
59
AOX TIMER
60
INTERRUPT
INTERRUPT
μC
20
FUNCTION SWITCHES
72
KEYBOARD
70
DISPLAY
68
66
F.M.
36
32
34
PUMP
RELAY
A-O REPL. RES.
30
21b
F.M.
44
40
42
PUMP
RELAY
FIX REPL. RES.
38
21c
F.M.
52
48
50
PUMP
RELAY
WASH REPL. RES.
46
21d
F.M.
28
26
24
PUMP
RELAY
DEV. EXH. REPL. RES.
22
21a

AUTOMATIC INVERSE FIX REPLENISHER CONTROL

REFERENCE TO CO-PENDING APPLICATION

Reference is hereby made to a co-pending application Ser. No. 168,019, U.S. Pat. No. 4,293,211 entitled AUTOMATIC REPLENISHER CONTROL SYSTEM filed on even date herewith and assigned to the same assignee as this application.

BACKGROUND OF THE INVENTION

1. Field of the Invention

The present invention relates to a fix replenisher control system for use in processors of photosensitive material.

2. Description of the Prior Art Automatic photographic film and paper processors transport sheets or webs of photographic film or paper through a sequence of processor tanks in which the photosensitive material is developed, fixed, and washed, and then transports the material through a dryer. It is well known that photographic processors require replenishment of the processing fluids to compensate for changes in the chemical activity of the fluids.

First, it has been recognized that replenishment is necessary to replace constituents used as photosensitive film or paper is developed in the processor. This replenishment is "use related" or "exhaustion" chemical replenishment. Both developer and fix solutions require exhaustion replenishment.

Second, chemical activity of the developer solution due to aerial oxidation occurs with the passage of time regardless of whether film or paper is being processed. Some replenishment systems provide additional replenishment of an "anti-oxidation" (A-O) replenishment solution which counteracts this deterioration.

Replenishment systems were originally manually operated. The operator would visually inspect the processed film or paper and manually operate a replenisher system as he deemed necessary. The accuracy of the manual replenisher systems was obviously dependent upon the skill and experience of the operator.

Various automatic replenishment systems have been developed for providing use-related replenishment. Examples of these automatic replenishment systems include U.S. Pat. Nos. 3,472,143 by Hixon et al; 3,529,529 by Schumacher; 3,554,109 by Street et al; 3,559,555 by Street; 3,561,344 by Frutiger et al; 3,696,728 by Hope; 3,752,052 by Hope et al; 3,787,689 by Fidelman; 3,927,417 by Kinoshita et al; 3,990,088 by Takita; 4,057, 818 by Gaskell et al; 4,104,670 by Charnley et al; 4,119,952 by Takahashi et al; 4,128,325 by Melander et al; and 4,134,663 by Laar et al. Examples of prior art replenisher controls for providing both exhaustion and anti-oxidation replenishment are shown in U.S. Pat. Nos. 3,822,723 by Crowell et al and 4,174,169 by Melander et al.

In the past, fix replenishment has been an inaccurate and costly proposition. Typically fix replenishment has been provided in a fixed ratio to developer exhaustion replenishment. This proves to be very inefficient as far as fix replenishment is concerned because the more developer which is used or exhausted, the less fix which is used or exhausted. The only point at which correct volumes of replenishment for both fix and developer exhaustion are reasonably accurate with prior art systems is at 50% density of the photosensitive material.

The direct coupling of developer and fix replenishment, as in the past, results in underreplenishing of fix when low density materials are processed, and overreplenishing of fix when high density material is processed.

SUMMARY OF THE INVENTION

The automatic control system of the present invention provides separate controls of developer exhaustion replenishment and fix exhaustion replenishment. In order to separately control fix and developer exhaustion replenishment, the system of the present invention determines both area and density of each strip processed in the processor. The width and length of each strip are sensed as the strip enters the processor. The density of each strip, on the other hand, is sensed after processing.

Developer exhaustion replenishment is provided by the system of the present invention as a function of a product of the area of the strip, the density of the strip, and a stored developer exhaustion rate. Fix exhaustion replenishment is provided as a function of a product of the area of the strip, and inverse of the density of the strip, and a stored fix exhaustion rate.

In addition, the present invention preferably includes a stored carryover rate which is indicative of carryover of developer fluid from a developer tank into a fix tank of a processor. A minimum fix replenishment is determined as a function of a product of the carryover rate and the area of the strip. The minimum fix replenishment is provided in the event that the minimum fix replenishment exceeds the fix exhaustion replenishment determined as a function of the product of the area, the inverse density, and the fix exhaustion rate.

BRIEF DESCRIPTION OF THE DRAWINGS

The FIGURE is a block diagram illustrating a preferred embodiment of the automatic replenishment control system of the present invention.

DETAILED DESCRIPTION OF PREFERRED EMBODIMENTS

In the system shown in the FIGURE, a photographic processor includes developer tank 10, fix tank 12, wash tank 14, and dryer 16. Film transport drive 18 transports the strip or web of photosensitive material (either film or paper) through tanks 10, 12, 14 and dryer 16. Microcomputer 20 controls operation of film transport 18 and of the automatic replenishment of fluids to tanks 10, 12 and 14.

The auto-replenishment system shown in the FIGURE includes developer replenisher **21*a* and anti-oxidation replenisher 21*b* for providing exhaustion and anti-oxidation replenishment, respectively, to developer tank 10. In addition, the system includes fix replenisher 21*c* for providing fix replenishment to fix tank 12, and wash replenisher 21*d* for providing wash replenishment to wash tank 14**.

Developer replenisher **21*a* includes exhaustion replenishment reservoir 22, pump 24, pump relay 26, and flow meter or switch 28. Exhaustion replenishment for developer tank 10 is supplied from exhaustion replenishment reservoir 22 by means of pump 24. Microcomputer 20 controls operation of pump 24 through pump relay 26. Flow meter or switch 28 monitors the exhaustion replenishment fluid actually pumped by pump 24 to developer tank 10, and provides a feedback signal to microcomputer 20**.

Anti-oxidation replenisher 21*b* includes A-O replenisher reservoir 30, pump 32, pump relay 34, and flow meter or switch 36. Anti-oxidation replenishment is supplied from A-O replenisher reservoir 30 to developer tank 10 by pump 32. Microcomputer 20 controls operation of pump 32 by means of relay 34. Flow meter or switch 36 monitors flow of A-O replenishment to developer tank 10 and provides a feedback signal to microcomputer 20.

Also shown in the FIGURE is developer circulation pump 37, which circulates the developer solution within developer tank 10. Microcomputer 20 controls operation of developer circulation pump 37.

Fix replenisher 21*c* includes fix replenisher reservoir 38, pump 40, pump relay 42, and flow meter or switch 44. Fix replenishment is supplied to fix tank 12 from fix replenisher reservoir 38 by pump 40, which is controlled by microcomputer 20 through relay 42. Flow meter or switch 44 monitors flow of replenishment fluid to fix tank 12, and supplies a feedback signal to microcomputer 20.

Wash replenisher 21*d*, which includes wash reservoir 46, pump 48, pump relay 50, and flow meter or switch 52, provides replenishment of wash fluid (typically water) in wash tank 14. The wash fluid is supplied from wash replenishment reservoir 46, and is pumped to wash tank 14 by pump 48, Microcomputer 20 controls pump 48 through relay 50, and monitors the flow of wash replenishment to tank 14 by means of flow meter or switch 52.

Microcomputer 20 utilizes developer counter 56, A-O counter 57, fix counter 58, and wash counter 59 as timers to control replenishment. When, for example, exhaustion replenishment is required, microcomputer 20 loads a numerical value (DEVTIME) into developer counter 56, which then begins counting. Microcomputer 20 energizes relay 26, which actuates pump 24. When developer counter 56 reaches a predetermined value (such as zero), it provides an interrupt signal to microcomputer 20, which de-energizes relay 26. The numerical value (DEVTIME), therefore, determines the total amount of exhaustion developer replenisher pumped into tank 10.

Counters 57, 58 and 59 are operated in a similar manner. The numerical values loaded into counters 57, 58 and 59 are hereafter referred to as AOXTIME, FIXTIME and WASHTIME, respectively.

AOX timer 60 is a countdown timer which provides an interrupt signal to microcomputer 20 on a periodic basis to initiate A-O replenishment. In one preferred embodiment, AOX timer 60 provides the interrupt signal every 22.5 minutes.

Microcomputer 20 also receives signals from film width sensors 62 and density scanner 64. Film width sensors 62 are positioned at the input throat of the processor, and provide signals indicating the width of the strip of photosensitive material as it is fed into the processor. Since microcomputer 20 also controls film transport 18, and receives feedback signals from film transport 18, the width signals from film width sensors 62 and the feedback signals from film transport 18 provide an indication of the area of photosensitive material being processed.

In a preferred embodiment of the present invention, film width sensors 62 are a reflective IR (infrared) sensor array located above the feed table (not shown) at the input throat of the processor. By locating the sensors 62 at the input throat, a separate film sense switch is not required. In addition, photosensitive material may be fed into the processor at any position across the feed table without having to worry that the material will be sensed. A reflective IR sensor array is used because it allows for detection of zero density film, which is transparent to transmittive IR, and it also allows for the IR source(s) and sensor(s) to be located on one side of the film only, thereby eliminating vapor and dirt problems. The reflective IR array may include an array of IR sources and a corresponding array of IR sensors, or may include a common IR source, an array of fiber optic light guides, and either an array of IR sensors or a common IR sensor and a second array of fiber optic light guides.

Density scanner 64 senses density of the processed photosensitive material. The signals from density scanner 64 provide an indication of the integrated density of the processed photosensitive material. The integrated density, together with the area of material processed, provides an indication of the amount of processor fluids used in processing that material.

Microcomputer 20 also receives signals from control panel 66, which includes function switches 68, keyboard 70, and display 72. Function switches 68 select certain functions and operating modes of the processor. Keyboard 70 permits the operator to enter numerical information, and other control signals used by microcomputer 20 in controlling operation of the processor, including replenishment. Display 72 displays messages or numerical values in response to control signals from microcomputer 20.

Microcomputer 20 preferably stores set values for each of a plurality of photosensitive materials that may be processed in the processor. Each group of set values includes pump rates for pump 24 (DEVPMPRATE), pump 32 (AOXPMPRTE), pump 40 (FIXPMPRTE) and pump 48 (WASHPMPRTE); desired replenishment rates of exhaustion developer (DEVRATE) A-O replenishment (AOXRATE), fix replenishment (FIXRTE), and wash replenishment (WASHRATE).

When operation is commenced, the operator selects one of the groups of set values which corresponds to the particular photosensitive material being processed. As the leading edge of each strip of photosensitive material is fed into the processor, film width sensors 62 sense the presence of the strip, and provide a signal indicative of the width of the strip being fed into the processor. Width sensors 62 continue to provide the signal indicative of the width of the strip until the trailing edge of the strip passes sensors 62. The length of time between the leading and trailing edges of the material passing sensors 62, and the transport speed of the material (which is controlled by microcomputer 20 through film transport 18) provide an indication of the length of the strip. The width and length information for each strip is stored until the strip has been transported through the processor and reaches density scanner 64. The area of the strip and the integrated density of the strip (which is provided by the signals from density scanner 64), provide an indication of the amounts of developer and fix which have been exhausted in processing that particular strip.

The present invention is an improved system for automatically controlling developer and fix exhaustion replenishment. For that reason, a detailed description of developer anti-oxidation replenishment and wash replenishment is not provided in this application. Reference may be made to the previously mentioned co-pending patent application entitled "Automatic Replenisher Control System" for further details.

TABLE A illustrates how microcomputer 20 determines and controls the amount of exhaustion developer replenishment to be supplied to developer tank 10.

TABLE A

| | |
|---|---|
| A.1 | Calculate AREA = WIDTH * LENGTH |
| A.2 | Calculate DEV REPL = DEVRATE * 2 * AREA * DENSITY |
| A.3 | Calculate DEVTIME = DEVREPL ÷ DEVMPRATE + DEVMINRUN |
| A.4 | If DEVTIME less than 7.5 seconds then<br>(1) Calculate DEVMINRUN = DEVMINRUN + DEVTIME<br>(2) Return to A.1 |
| A.5 | Output DEVTIME to counter 56 |
| A.6 | Trigger pulse sent to counter 56 and<br>(1) Replenish flag (DEV) set |
| A.7 | Counter 56 begins decrementing and<br>(1) Developer replenishment pump 24 runs |
| A.8 | If flow switch 28 does not activate and/or developer replenishment pump relay 26 does not energize then ERROR else |
| A.9 | If pump enable is turned off while counter 56 is running then<br>(1) Wait 5 seconds<br>(2) If change then resume A.8 else<br>(3) Read value remaining in counter 56 to DEVREM<br>(4) Clear counter 56<br>(5) Calculate AOXDEV = AOXDEV + (DEVTIME − DEVREM) DEVPMPRTE<br>(6) Reset replenish flag (DEV)<br>(7) Return to A.1 |
| A.10 | Counter 56 times out and<br>(1) Interrupt request generated |
| A.11 | If interrupt request not acknowledged then wait, else |
| A.12 | If flow switch 28 remains activated and/or pump relay 26 remains energized then ERROR else |
| A.13 | Calculate AOXDEV = AOXDEV + DEVREPL |
| A.14 | Reset replenish (DEV) flag, clear DEVMINRUN |
| A.15 | Return to A.1 |

As shown in steps A.3 and A.4, microcomputer 20 preferably accumulates DEVTIME as DEVMINRUN until the total DEVTIME required exceeds 7.5 seconds. This provides greater accuracy, since control of pump 24 for a period less than 7.5 seconds is difficult and likely to cause inaccuracy. Similar accumulations of times are provided for the other pumps.

In the system of the present invention, the amount of fix used is inversely related to the amount of developer which is used. This differs from conventional replenishment systems, which typically provide equal amounts of developer and fix replenishment.

In the particular embodiment illustrated in TABLE C below, the fix replenishment (FIXREPL) is normally a function of a product of the stored fix replenishment rate (FIXRTE), the area of the film, (AREA), and an inverse of density (1-DENSITY), where DENSITY is a numerical value between 0 to 1.

In addition, a carryover rate (CORTE), which guarantees a minimum amount of fix replenishment, is preferably used to account for the carryover of developer chemistry by the film as it leaves developer tank 10 and enters fix tank 12. This carryover of developer chemistry into the fix tank 12 results in a use of more fix solution than would be indicated by the information from film width sensors 54 and density scanner 56.

Table C illustrates how microcomputer 20 determines and controls fix replenishment.

TABLE C

| | |
|---|---|
| C.1 | If FIXRTE * 2 * AREA * (1-DENSITY) < CORTE * AREA then FIXREPL = CORTE * AREA; else FIXREPL = FIXRTE * 2 * AREA * (1-DENSITY) |
| C.2 | Calculate FIXTIME = FIXREPL ÷ FIXPMPRTE + FIXMINRUN |
| C.3 | If FIXTIME less than 7.5 seconds then<br>(1) Calculate FIXMINRUN − FIXMINRUN = FIXTIME<br>(2) Return to a.1 |
| C.4 | Output FIXTIME to counter 58 |
| C.5 | Trigger pulse sent to counter 58 and<br>(1) Replenish flag (FIX) set |
| C.6 | Counter 58 begins decrementing and fix replenishment pump relay 42 does not energize then ERROR |
| C.7 | If pump enable is turned off while counter 58 is running then<br>(1) Wait 5 seconds<br>(2) If change then resume C.6 else<br>(3) Read value remaining in counter 58 to FIXREM<br>(4) Clear counter 58<br>(5) Replenish flag (FIX) reset<br>(6) Return to A.1 |
| C.8 | Counter 58 times out and<br>(1) Interrupt request generated |
| C.9 | If interrupt request not acknowledged then wait else |
| C.10 | If flow switch 44 remains activated and/or pump relay 42 remains energized then ERROR else |
| C.11 | Reset replenish (FIX) flag |
| C.12 | Return to A.1 |

In conclusion, the replenishment control system of the present invention provides more accurate control of fix replenishment than has been present in the prior art systems. By individually controlling developer exhaustion replenishment and fix exhaustion replenishment, the amount of fix replenishment supplied is an inverse function of density, rather than a direct function of density as in prior art systems. This avoids both inaccuracies in the amount of fix replenishment and waste of fix replenishment which is common in prior art systems.

Although the present invention has been described with reference to preferred embodiments, workers skilled in the art will recognize that changes may be made in form and detail without departing from the spirit and scope of the invention.

What is claimed is:

1. In a processor of strips of photosensitive material having a developer tank for containing developer fluid; a fix tank for containing fix fluid; a wash tank for containing wash fluid; a dryer for drying the strips; means for sequentially transporting the strips through the developer tank, the fix tank, the wash tank, and the dryer; means for determining area of a strip transported through the processor; means for sensing density of the strip after the strip has been transported through the developer tank and the fix tank; means for storing a developer exhaustion rate; means for automatically determining a developer exhaustion replenishmen value as a function of a product of the determined area of the strip, the sensed density of the strip, and the stored developer exhaustion rate; means for supplying a quantity of developer exhaustion replenishment fluid to the developer tank as a function of the developer exhaustion replenishment value; the improvement comprising:

means for storing a fix replenishment rate;

means for automatically determining a fix replenishment value as a function of a product of the determined area of the strip, an inverse of the sensed density of the strip, and the stored fix replenishment rate; and means for supplying a quantity of fix replenishment fluid to the fix tank as a function of the fix replenishment value.

2. The invention of claim 1 and further comprising:

means for storing a carryover rate indicative of carryover of developer fluid from the developer tank to the fix tank;

means for automatically determining a minimum fix replenishment value as a function of a product of the carryover rate and the determined area of the strip;

means for causing the means for supplying a quantity of fix replenishment fluid to the fix tank to supply a quantity of fix replenishment fluid which is a function of the minimum fix replenishment value in the event that the minimum fix replenishment value exceeds the fix replenishment value.

3. The invention of claim 1 wherein the means for supplying a quantity of developer exhaustion replenishment fluid comprises:

a developer exhaustion replenishment reservior for containing developer exhaustion replenishment fluid;

a developer exhaustion replenishment pump for pumping, when actuated, developer exhaustion replenishment fluid from the developer exhaustion replenishment reservior to the developer tank; and means for actuating the developer exhaustion replenishment pump to pump a volume of developer exhaustion replenishment fluid which is a function of the developer exhaustion replenishment value.

4. The invention of claim 1, 2 or 3 wherein the means for supplying a quantity of fix replenishment fluid comprises:

a fix replenishment reservoir for containing fix replenishment fluid;

a fix replenishment pump for pumping, when actuated, fix replenishment fluid from the fix replenishment reservior to the fix tank; and means for actuating the fix replenishment pump to pump a volume of fix replenishment fluid which is a function of the fix replenishment value.

* * * * *